US008656623B1

(12) United States Patent
Chvala

(10) Patent No.: US 8,656,623 B1
(45) Date of Patent: Feb. 25, 2014

(54) SIDE FOLDING STOCK ASSEMBLY WITH CONCEALED HINGE ARRANGEMENT

(71) Applicant: Advanced Technology International USA, LLC, Milwaukee, WI (US)

(72) Inventor: John R. Chvala, Grafton, WI (US)

(73) Assignee: Advanced Technology International USA, LLC, Cedarburg, WI (US)

( * ) Notice: Subject to any disclaimer, the term of this patent is extended or adjusted under 35 U.S.C. 154(b) by 0 days.

(21) Appl. No.: 13/670,561

(22) Filed: Nov. 7, 2012

(51) Int. Cl.
*F41A 11/04* (2006.01)

(52) U.S. Cl.
USPC ..... 42/75.03; 42/73

(58) Field of Classification Search
USPC ..... 42/71.01, 71.02, 72, 73, 74, 75.03, 42/75.01; 16/362, 364, 366, 367, 369, 368
See application file for complete search history.

(56) References Cited

U.S. PATENT DOCUMENTS

| | | | | | |
|---|---|---|---|---|---|
| 33,830 | A * | 12/1861 | Dodge | 16/366 |
| 521,202 | A * | 6/1894 | Burgess | 42/71.01 |
| 524,800 | A * | 8/1894 | Burgess | 42/71.01 |
| 543,138 | A * | 7/1895 | Murray | 42/71.01 |
| 652,583 | A * | 6/1900 | Baird | 42/71.01 |
| 1,030,936 | A * | 7/1912 | Soss | 16/369 |
| 1,108,308 | A * | 8/1914 | Zuckerman | 16/369 |
| 1,269,403 | A * | 6/1918 | Dianovszky, Sr. | 16/369 |
| 1,280,357 | A * | 10/1918 | Zuckerman | 16/369 |
| 1,484,093 | A * | 2/1924 | Soss | 16/358 |
| 2,135,280 | A * | 11/1938 | Erickson | 16/369 |
| 3,001,224 | A * | 9/1961 | Soss | 16/276 |
| 3,369,316 | A * | 2/1968 | Miller | 42/72 |
| 3,512,211 | A * | 5/1970 | Eraclio | 16/358 |
| 3,886,627 | A * | 6/1975 | Bassan | 16/387 |
| 5,209,215 | A * | 5/1993 | Morrison | 124/25 |
| 6,591,533 | B2 * | 7/2003 | Wygant | 42/72 |
| 7,197,790 | B1 * | 4/2007 | Edmondson | 16/336 |
| 7,673,412 | B2 * | 3/2010 | Griffin | 42/73 |
| 7,754,950 | B2 * | 7/2010 | Leach | 84/293 |
| 7,827,721 | B2 * | 11/2010 | Griffin | 42/73 |
| 7,966,761 | B1 * | 6/2011 | Kuczynko et al. | 42/73 |
| 8,245,429 | B2 * | 8/2012 | Kuczynko et al. | 42/73 |
| 8,312,661 | B2 * | 11/2012 | Ludlow | 42/73 |
| 8,429,844 | B2 * | 4/2013 | Dextraze et al. | 42/73 |
| 8,522,465 | B2 * | 9/2013 | Jarboe et al. | 42/16 |
| 2006/0242880 | A1 * | 11/2006 | Griffin | 42/73 |
| 2008/0141488 | A1 * | 6/2008 | Leach | 16/223 |
| 2008/0141842 | A1 * | 6/2008 | Leach | 84/293 |
| 2009/0173207 | A1 * | 7/2009 | Leach | 84/293 |
| 2010/0212206 | A1 * | 8/2010 | Griffin | 42/73 |
| 2010/0307042 | A1 * | 12/2010 | Jarboe et al. | 42/6 |
| 2011/0131857 | A1 * | 6/2011 | Kuczynko et al. | 42/73 |
| 2012/0030983 | A1 * | 2/2012 | Kuczynko et al. | 42/73 |

(Continued)

*Primary Examiner* — Jonathan C Weber
(74) *Attorney, Agent, or Firm* — Andrus Intellectual Property Law, LLC

(57) ABSTRACT

A firearm assembly includes a shoulder stock assembly having a hinge arrangement including a first hinge portion mounted within a rear portion of a firearm assembly, and a second hinge portion mounted within the shoulder stock assembly. The shoulder stock assembly and the rear portion of the firearm assembly are movable into and out of locking alignment with one another. A translation linkage is located between the first and second hinge portions for permitting the first and second hinge portions to move into and out of spaced apart alignment with one another. The hinge portions and the translation linkage are substantially concealed from view when the shoulder stock assembly and the rear portion of the firearm assembly are moved into locking alignment with one another.

18 Claims, 8 Drawing Sheets

(56) References Cited

U.S. PATENT DOCUMENTS

2012/0047786 A1* 3/2012 Dextraze et al. ..... 42/18
2012/0137561 A1* 6/2012 Ludlow ..... 42/75.03
2012/0137562 A1* 6/2012 Langevin et al. ..... 42/75.03
2012/0257368 A1* 10/2012 Bohn et al. ..... 361/809
2012/0286224 A1* 11/2012 Duffy et al. ..... 256/22
2013/0212920 A1* 8/2013 Law ..... 42/75.03

* cited by examiner

SIDE FOLDING STOCK ASSEMBLY WITH CONCEALED HINGE ARRANGEMENT

BACKGROUND OF THE INVENTION

The present disclosure relates generally to firearms, and more particularly, pertains to a variably configurable firearm stock assembly to facilitate firearm grip and handling.

There has been a long standing recognition as to the desirability of firearms in which the stock can be moved between folded and unfolded, as well as between collapsed and extended, positions. Such positions are useful during transport, storage and use of firearms, and are particularly advantageous in certain tactical situations.

Folding stocks are characterized by a stock assembly pivotably mounted on the rear end of a firearm between a folded storage position lying over the top or alongside the firearm, and an unfolded operative position in which the stock assembly is moved to and locked in a shoulder-engaging orientation extending rearwardly from the firearm. Side folding stocks are known to employ a hinge arrangement which is located between the rear of the firearm and the stock assembly, and is typically positioned exterior of the firearm and the stock assembly in both the folded and the unfolded positions.

Attempts have been made to advance functionality of the side folding stock assembly, but have generally been found not to be reliable and durable over repeated operations. Previously, side folding stock assemblies have been unsatisfactory due to, among other things, numerous pieces or complexity of parts, unreliable transition and occasional jamming between folded and unfolded configurations, and create interference when operating the firearm. In addition, the continuously exposed hinge arrangements used in side folding stock assemblies are vulnerable to certain environmental conditions (e.g. rain, snow, mud, water, etc.) and operating conditions (e.g. undesirable contact or impact with other objects) which can negatively affect performance. Further, continuously exposed hinge arrangements of known side folding stock assemblies can detract from an overall, streamlined appearance of the firearm.

Accordingly, there is a need for a side folding stock assembly incorporating a hinge arrangement which overcomes the shortcomings of previous designs, and provides a reliable, aesthetically desirable design. There is also a need to provide such a hinge arrangement which is concealed inside the firearm and the side folding stock assembly when the latter is in the unfolded and locked position, and is minimally exposed at the rear of the firearm when the side folding stock assembly is in the folded position.

SUMMARY OF THE INVENTION

The present disclosure relates to a hinge arrangement for a firearm assembly including a first hinge portion adapted to be mounted in one of a firearm assembly and a stock assembly, and a second hinge portion adapted to be mounted in the other of the firearm assembly and the stock assembly. A translation linkage is positioned between the first and second hinge portions for permitting the first and second hinge portions to move into and out of spaced apart alignment with each other. The translation linkage is located substantially within the first and second hinge portions when the first and second hinge portions are moved into spaced apart alignment with each other.

In the preferred embodiment, one of the hinge portions is provided with a ramp surface structure and a locking notch structure. Each of the hinge portions is provided with external mounting structure adapted to be received and retained in the firearm and the stock assembly. Each of the firearms has a sidewall formed with slot structure, and includes an interior mounting space for mounting the translation linkage. The hinge portions have internal mounting bases which are coplanar with each other when the hinge portions are moved into spaced apart alignment with one another. The translation linkage includes a set of swing arms swingably mounted on hinge pins, and configured in a stacked overlapping relationship. The hinge pins include a first set of hinge pins fixed relative to the hinge portions, and a second set of hinge pins movable relative to the hinge portions.

The present disclosure further relates to a folding firearm stock assembly including a shoulder stock assembly having a hinge arrangement including a first hinge portion adapted to be mounted to a rear portion of a firearm assembly, and a second hinge portion mounted to the shoulder stock assembly. A translation linkage is located between the first and second hinge portions for permitting the first and second hinge portions to move into and out of spaced apart alignment with one another. The translation linkage is located substantially within the first and second hinge portions to conceal the side folding mechanism when the first and second hinge portions are moved into spaced apart alignment with each other. The concealed linkage provides for a streamlined appearance to the firearm when the stock is in the extended, operative position.

The second hinge portion is mounted substantially entirely within the stock assembly. The shoulder stock assembly includes a buffer tube for receiving and retaining the second hinge portion therein. The buffer tube includes a locking collar which is engageable and disengagable with locking structure on the first hinge portion. The locking collar is mounted for sliding and rotational movement on the buffer tube. The locking collar includes a tooth structure which is engageable and disengagable with a ramp surface structure on the first hinge portion. The translation linkage includes a set of swing arms swingably mounted in a stacked overlapping relationship on a set of hinge pins fixedly and movably mounted in the hinge portions.

The present disclosure further relates to a firearm assembly including a shoulder stock assembly having a hinge arrangement including a first hinge portion mounted within a rear portion of a firearm assembly, and a second hinge portion mounted within the shoulder stock assembly. The shoulder stock assembly and the rear portion of the firearm assembly are movable into and out of locking alignment with one another. A translation linkage is located between the first and second hinge portions for permitting the first and second hinge portions to move into and out of spaced apart alignment with one another. The hinge portions and the translation linkage are substantially concealed from view when the shoulder stock assembly and the rear of the firearm assembly are moved into locking alignment with one another.

In accordance with the present disclosure, the shoulder stock assembly can be configured to fold to either the left or right of the firearm, depending upon the user preference. The variable configuration allows for further customization of the firearm.

The hinge portions are mounted so as to prevent any axial and rotational movement within the rear portion of the firearm assembly and the shoulder stock assembly. The shoulder stock assembly includes a locking collar rotatably and slidably mounted thereon. The locking collar is engageable and disengagable with locking structure on the first hinge portion. The translation linkage is located substantially entirely within the hinge portions when the hinge portions are moved into spaced alignment with one another.

BRIEF DESCRIPTION OF THE DRAWINGS

The drawings illustrate the best mode presently contemplated in carrying out the disclosure. In the drawings.

DETAILED DESCRIPTION

Figure 1:
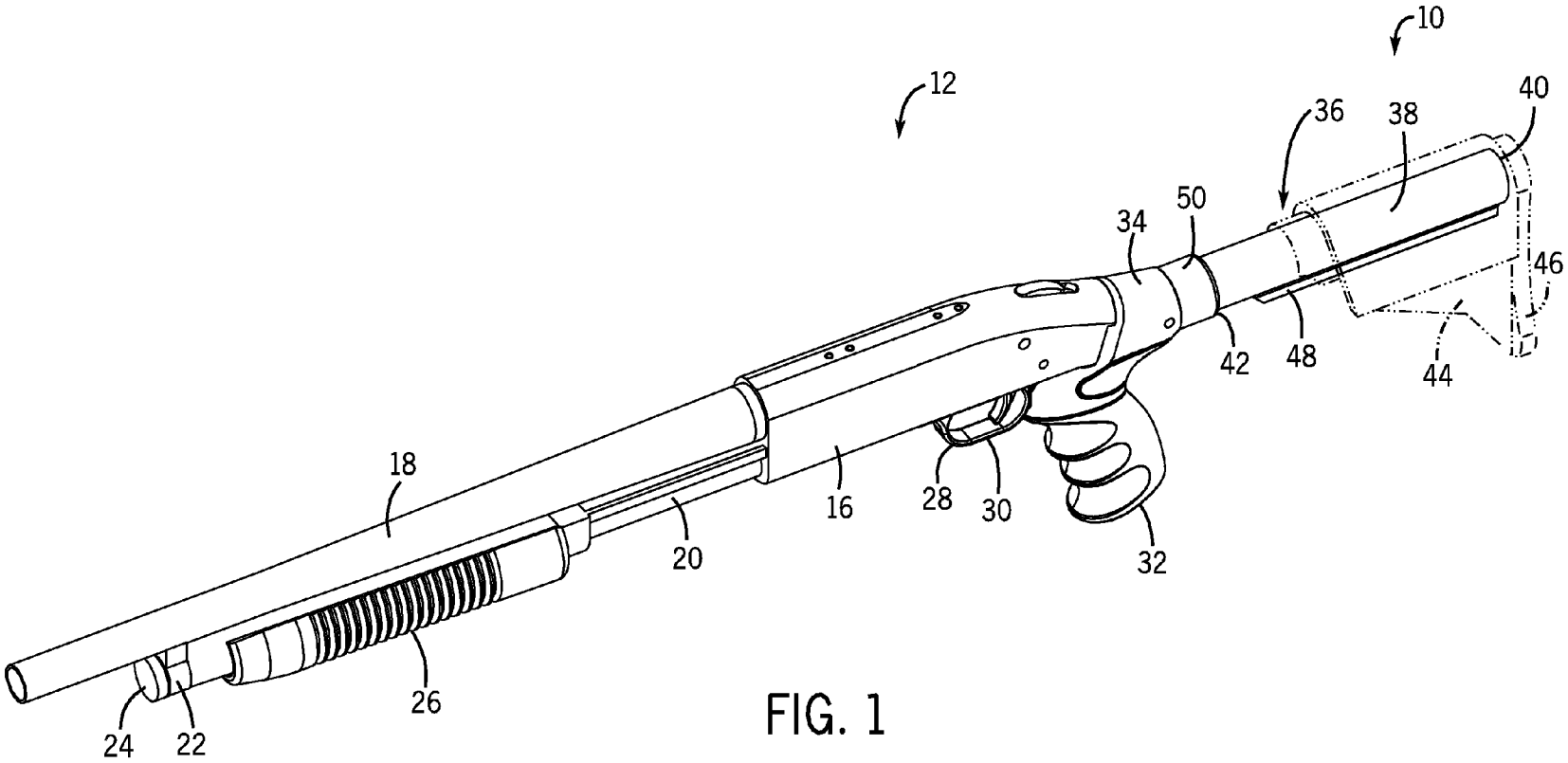
FIG. 1 is a top perspective view of a shotgun showing a side folding stock assembly shown in an unfolded, locked position, and provided with a concealed hinge arrangement.
Figure 2:
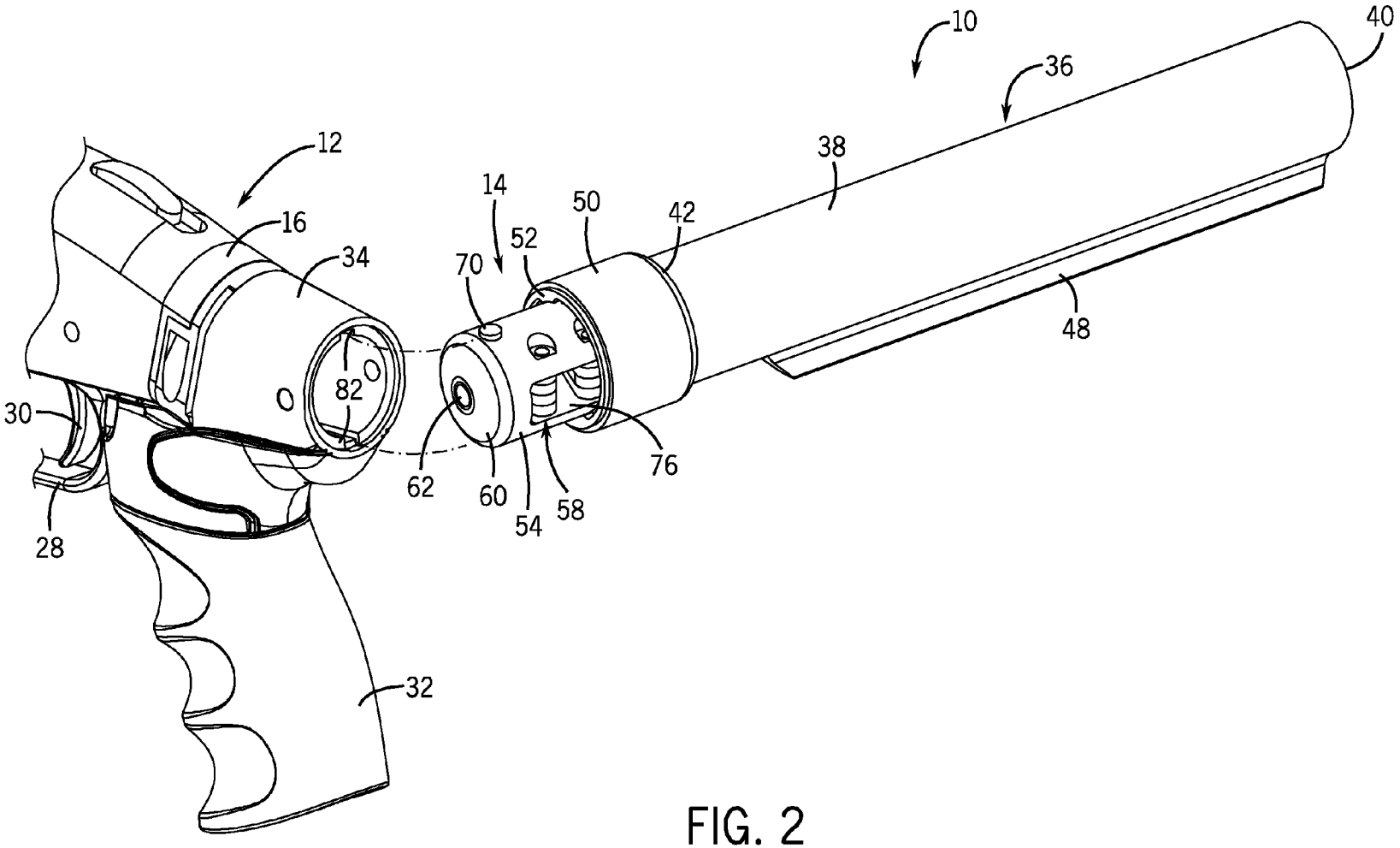
FIG. 2 is a fragmentary exploded view of a rear portion of FIG. 1 showing the stock assembly and hinge arrangement removed from the shotgun.

Referring now to the drawings, FIG. 1 illustrates a side folding stock assembly 10 which is provided on a rear portion of a firearm assembly, such as a shotgun 12, and which can be detached therefrom as shown in FIG. 2. The side folding stock assembly 10 is pivotably mounted to the rear portion of the shotgun 12 between an unfolded position (FIGS. 1 and 3), and a folded position (FIG. 4) by means of a hinge arrangement 14 located between the stock assembly 10 and the shotgun 12. The hinge arrangement 14 is designed to be concealed from view when the stock assembly 10 is pivoted on the rear portion of the shotgun 12 to the unfolded position in which the stock assembly 10 is moved into a locking alignment with the rear portion of the shotgun along a longitudinal axis passing through the stock assembly 10 and the shotgun 12.

Shotgun 12 typically includes a receiver 16, a barrel 18, and a magazine tube 20 extending beneath the barrel 18. A forward portion of the magazine tube 20 engages a barrel lug 22 and is held thereto by a magazine cap 24. A gripping forend 26 is slidably mounted for back and forth movement relative to the magazine tube 20. Shotgun 12 also includes a trigger guard 28, a trigger 30, and a pistol grip 32 connected via a mounting device 34 at a rear end of the receiver 16.

In accordance with the present disclosure, the folding stock assembly 10 generally includes a shoulder stock assembly 36 having a shoulder stock or buffer tube 38 provided with an outer closed end 40 and an open inner end 42 (FIG. 8) for receiving and retaining the hinge arrangement 14 as best seen in FIG. 2. A butt stock 44 having a butt plate 46 (shown in phantom lines of FIG. 1) is mounted on a rear portion and the closed end 40 of the buffer tube 38, and typically carries a butt pad adapted to engage the shoulder of a shooter during use of the shotgun 12 as is well known. Although not illustrated, the butt stock 44 and butt plate 46 can be slidably mounted for longitudinal adjustment on the bottom 48 of the buffer tube 38 to permit users with a range of arm lengths to hold the shotgun 12 comfortably against their shoulder regardless of the length of their arms or the type of clothing or gear being worn at the time of use. A cylindrical locking collar 50 is mounted for rotational and sliding movement at the inner end 42 of buffer tube 38, and surrounds a portion of the hinge arrangement 14. An inner end of the collar 50 is provided with a pair of diametrically opposite, inwardly projecting teeth 52 (one being seen in FIGS. 5 and 6). The teeth 52 are uniquely engageable and disengagable with the hinge arrangement 14 during movement of the stock assembly 10 into and out of locking alignment with the rear portion of shotgun 12 as will be further explained below. The locking collar 50 is normally formed with a knurled external surface to enhance gripping during sliding and rotation of the collar 50.

Referring to FIGS. 2, 3, 5-9 and 12, the hinge arrangement 14 includes a first hinge portion 54, a second hinge portion 56 and a translation linkage 58 interposed between the first and second hinge portions 54, 56 for permitting the hinge portions 54, 56 to move in a pivoting motion into and out of spaced apart alignment with each other.

First hinge portion 54 is designed to be received and retained within a rear portion of the shotgun 12, namely, the mounting device 34. The first hinge portion 54 is constructed as a generally cylindrical, cup-like housing including an outer end wall 60 provided with a throughhole 62, a sidewall 64 formed with oppositely facing slots 66, and an open inner end 68. The slots 66 and the open end 68 communicate with an interior mounting space within the housing. The hinge portion 54 also includes a pair of diametrically opposite projections 70 (one being seen in the drawings) extending outwardly from sidewalls 64, and a pair of recesses 72, 73 formed through an upper portion of sidewall 64. In addition, a locking notch 74 is formed in the top and bottom of the sidewall 64, and a flat internal base 76 is provided as a mounting surface for the translation linkage 56. Inner end 68 of hinge portion 54 is formed with top and bottom radially extending portions 78 (FIGS. 6-9), each having a ramp surface 80 which terminates adjacent one of the respective notches 74. As will be further explained below, each tooth 52 on locking collar 50 is operatively engaged with a respective ramp surface 80 and a respective notch 74 to selectively lock and unlock the folding stock assembly 10 to the rear of shotgun 12.

In the exemplary embodiment shown in FIG. 2, projections 70 on first hinge portion 54 are aligned with opposed keyways 82 formed on top and bottom surfaces of mounting surface 34, and the sidewalls 64 are slidably inserted therein. A fastener (not shown) is then passed through an internal wall of the mounting device 34 from the inside thereof, and threaded into the throughhole 62 in outer end wall 60. Such connection retains the hinge portion 54 within the mounting device 34 at the rear of shotgun 12, and prevents any axial movement of hinge portion 54 therein. The engagement of projections 70 with the keyways 82 precludes any rotation of the hinge portions 54 within mounting device 34.

Second hinge portion 56 is designed to be received and retained within the opening 42 of buffer tube 38. In the exemplary embodiments of FIGS. 8 and 11, the second hinge portion 56 is constructed of a generally cylindrical, cup-like housing including an outer end wall 84, a sidewall 86 formed with oppositely facing slots 88, and an open inner end 90. The slots 88 and the open end 90 communicate with an interior mounting space within the housing. The hinge portion 56 also includes top and bottom radially extending portions 92 provided at the inner end 90, a pair of recesses 94, 95 formed through the sidewall 86 and a flat internal base 96 defining a mounting surface for the translation linkage 58. The bases 76 and 96 are coplanar with each other when the hinge portions 54, 56 are moved into spaced apart alignment as seen in FIGS. 8 and 9.

The outer end wall 84 is provided with a central hole 98 and a pair of semi-cylindrical segments 100. Segments 100 are received in complimentary shaped recesses 102 formed in a transverse wall 104 recessed from the inner end 42 of buffer tube 38, and engaged by the outer end wall 84. A fastener (not shown) is passed from the inside of the outer end wall 84 through hole 98, and is threaded into the surface defining an aperture 106 in the transverse wall 104. Such connection ensures that there is no rotational or axial sliding movement of the hinge portion 56 within the buffer tube 38.

Figure 11:
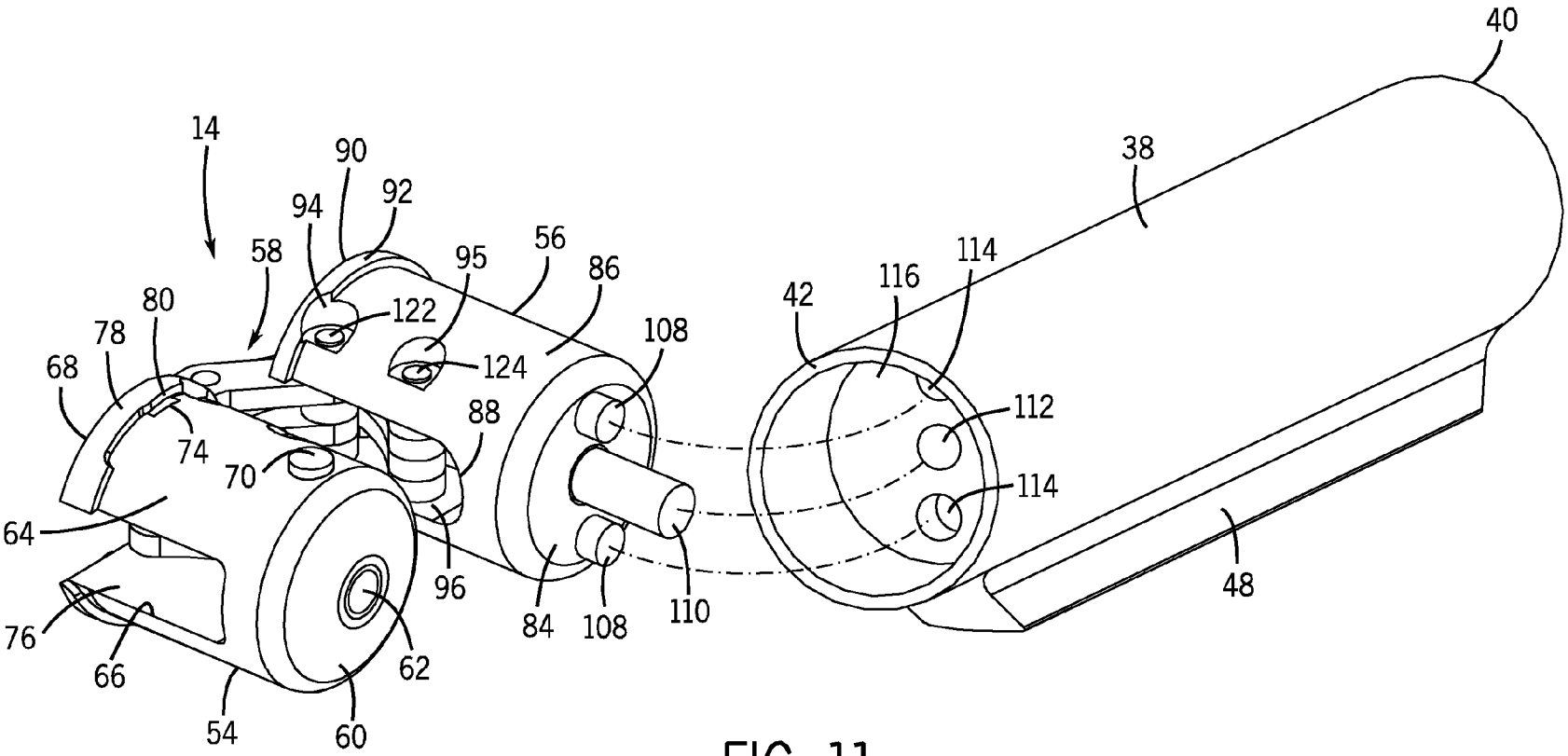
FIG. 11 is an exploded perspective view of an alternative mounting of a folded hinge arrangement relative to a buffer tube of the stock assembly.
Figure 12:
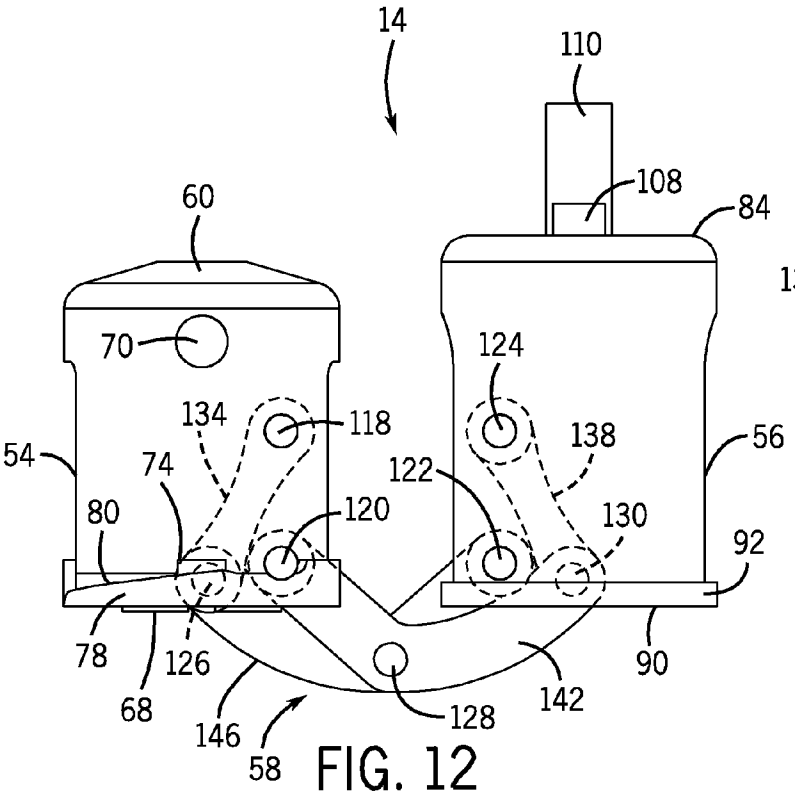
FIG. 12 is a bottom view of the hinge arrangement of FIG. 11.

FIGS. 11 and 12 illustrate an alternative buffer tube mounting for the second hinge portion 56 wherein the outer end wall 84 is shown configured with upper and lower short fingers 108 and a longer central finger 110. The fingers 108, 110 are received and retained in any suitable manner within walls forming holes 112, 114 provided in a transverse wall 116 recessed from the inner end 42 of buffer tube 38, and engaged by the outer end wall 84. The retention of hinge portion 56 within buffer tube 38 is designed to prevent any axial movement of the hinge portion 56 within buffer tube 38. The engagement of the fingers 108, 110 within the walls forming holes 112, 114 serves to preclude any rotation of the hinge portion 56 within the buffer tube 38.

Figure 8:
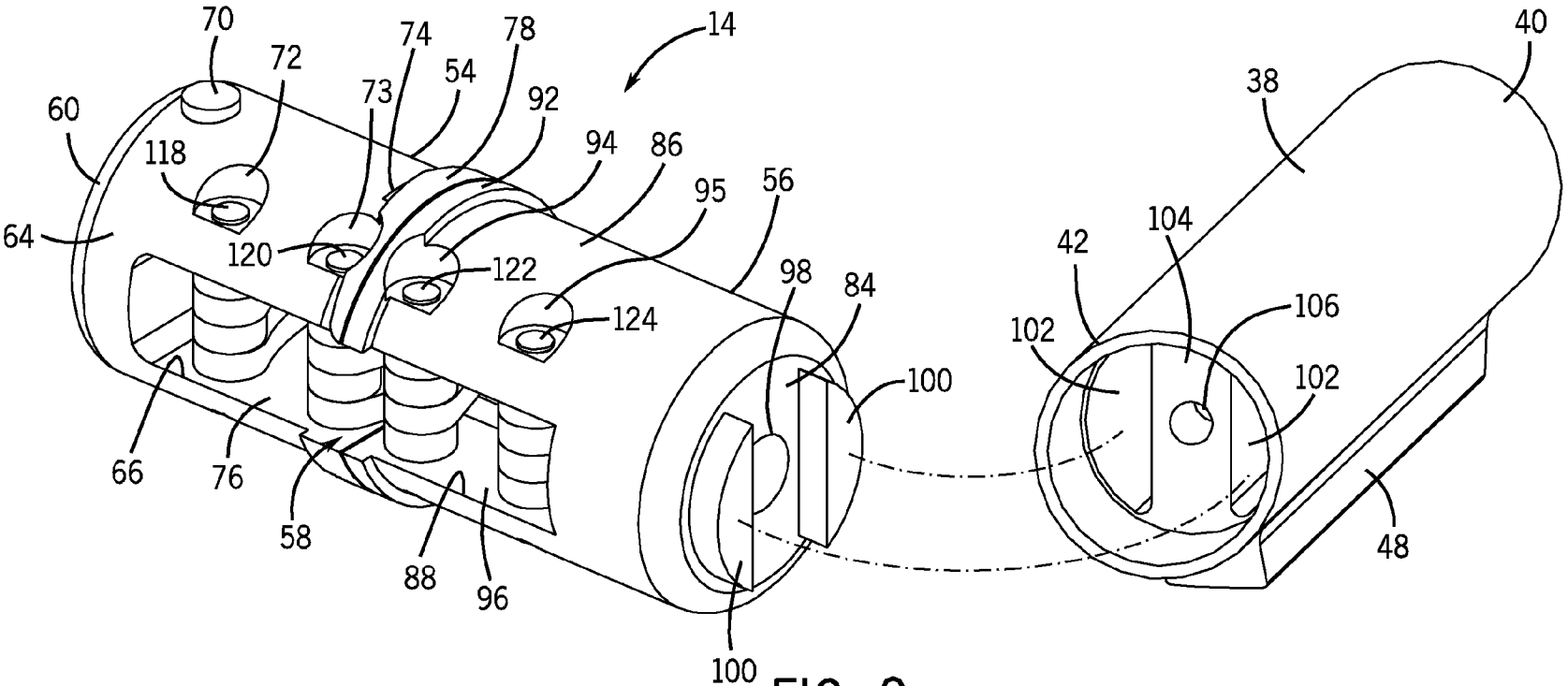
FIG. 8 is an exploded perspective view of the mounting of an unfolded hinge arrangement relative to a buffer tube of the stock assembly.
Figure 9:
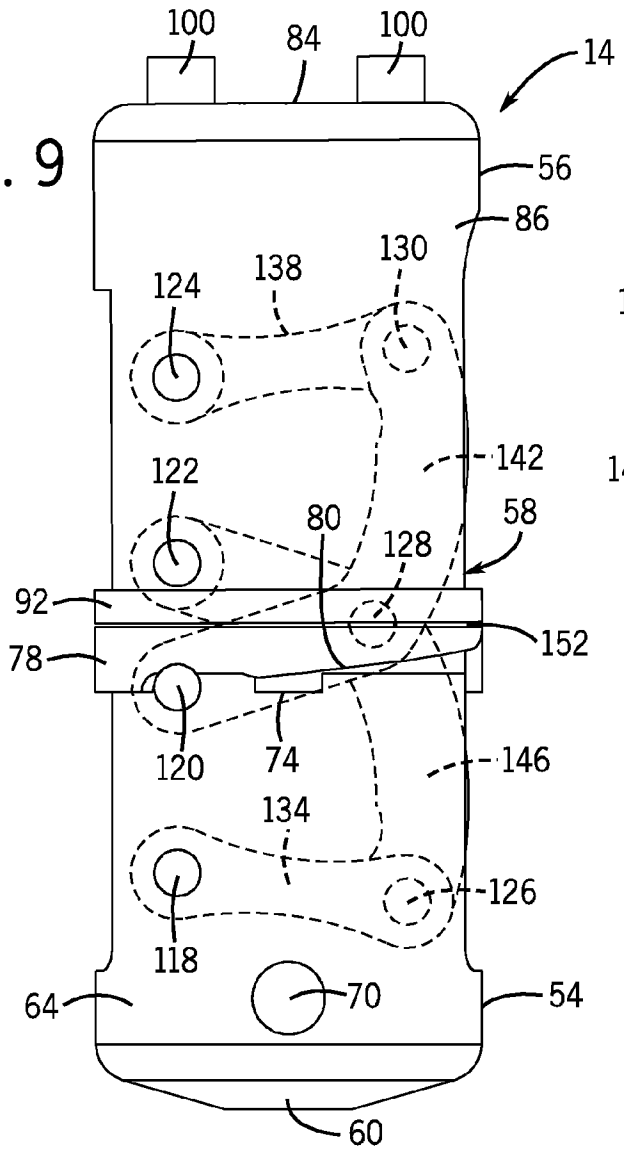
FIG. 9 is a bottom view of a hinge arrangement shown in FIG. 8.

The translation linkage 58 is embodied in a hinge pin and swing arm assembly which allows the hinge portions 54, 56 designed to be installed in mounting device 34 and buffer tube 38 to swing back and forth between the unfolded position of FIGS. 8 and 9 and the folded position of FIGS. 11 and 12. The translation linkage 58 includes fixed hinge pins 118, 120, 122, 124, movable hinge pins 126, 128, 130, outer swing arms 132, 134, 136, 138, inner swing arms 140, 142, 144, 146, and spacers 148, 150, all of which are interconnected together. More particularly, fixed hinge pins 118, 120 have bottom ends embedded in the mounting surface 76 of first hinge portion 54, and top ends which protrude through the sidewalls 64 into recesses 72, 73, respectively. Fixed hinge pins 122, 124 have bottom ends embedded in the mounting surface 96 of hinge portion 56, and top ends which protrude through the sidewall 86 into recesses 94, 95, respectively. Movable hinge pins 126, 128, 130 are designed to move relative to the hinge portions 54, 56 during movement between the folded and unfolded positions thereof.

Outer arms 132, 134 each have one end swingably attached to fixed hinge pin 118, and an opposite end swingably attached to movable hinge pin 126. A first set of spacers 148, 150 is mounted on hinge pin 118 on top of swing arm 132 and between swing arms 132, 134. Outer arms 136, 138 each have one end swingably joined to fixed hinge pin 124, and an opposite end swingably affixed to movable hinge pin 130. A second set of spacers 148, 150 is mounted on hinge pin 130 between swing arms 136, 138 and beneath swing arm 138.

Inner arms 140, 142 each have one end swingably connected to fixed hinge pin 120, and an opposite end swingably coupled to movable hinge pin 130. A third set of spacers 148, 150 is mounted on hinge pin 120 on top of swing arm 140 and between swing arms 140, 142. Inner arms 144, 146 each have one end swingably mounted on fixed hinge pin 122, and an opposite end swingably secured to movable hinge pin 126. A fourth set of spacers 148, 150 is mounted on hinge pin 122 between swing arms 144, 146 and beneath swing arm 146. Movable hinge pin 128 swingably connects intermediate portions of swing arms 140, 142, 144, 146.

Figure 10:
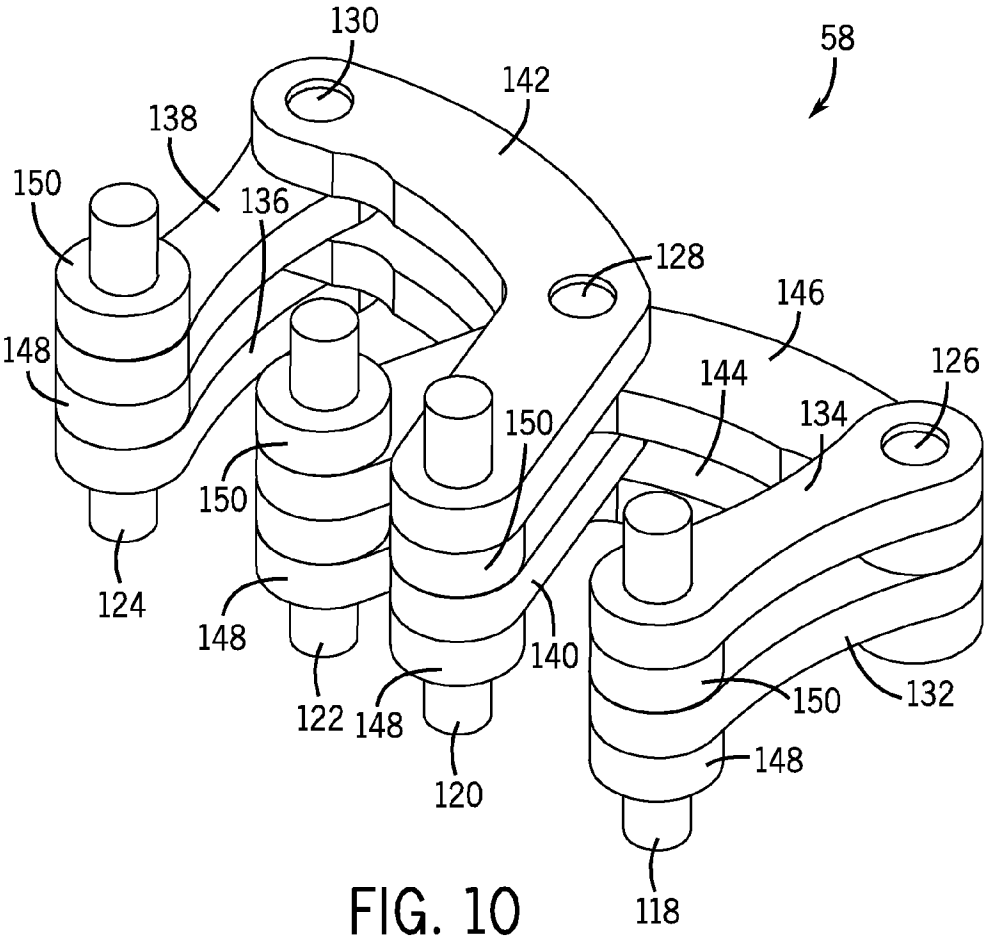
FIG. 10 is a perspective view of a translation linkage used in the hinge arrangement of FIG. 9.
Figure 13:
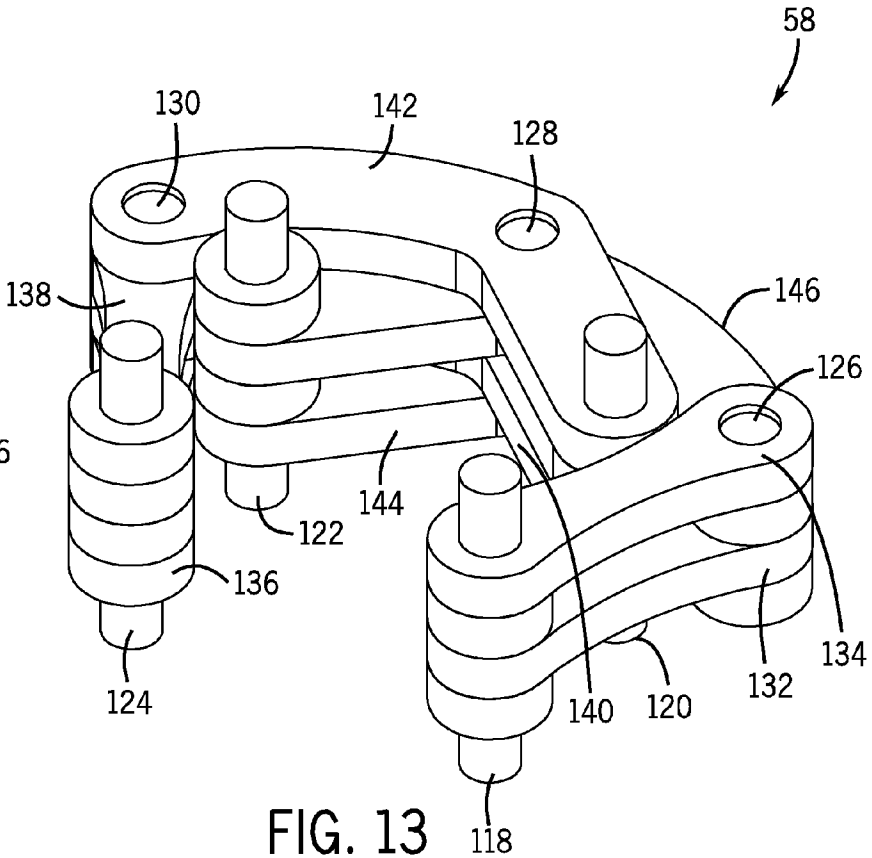
FIG. 13 is a perspective view of the translation linkage shown in FIG. 12.

The translation linkage 58 thus provides a set of swing arms joined together for movement in a stacked overlapping relationship as best seen in FIGS. 10 and 13. It should be appreciated that the translation linkage 58 enables the first and second hinge portions 54, 56 to be placed in alignment with each other, as seen in FIG. 9, such that a slight gap or space 152 exists between them. When the first and second hinge portions 54, 56 are in spaced apart alignment with each other, the translation linkage 58 lies substantially entirely within the hinge portions 54, 56. It should also be understood that while the translation linkage 58 permits swinging movement of the hinge portions 54, 56, locking and unlocking of the hinge portions 54, 56 relative to the aligned position is separately achieved by the locking collar 50 as will be detailed below.

Figure 3:
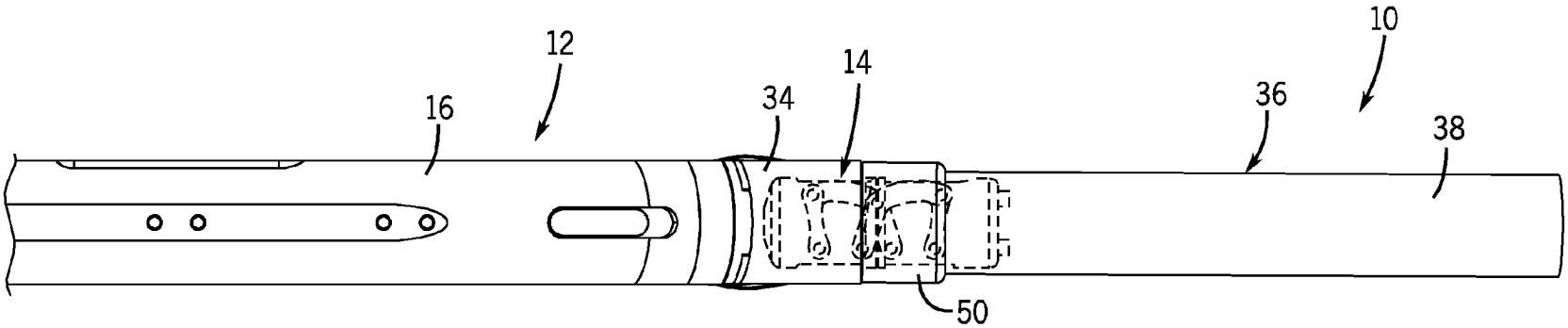
FIG. 3 is a top view of FIG. 1.
Figure 4:
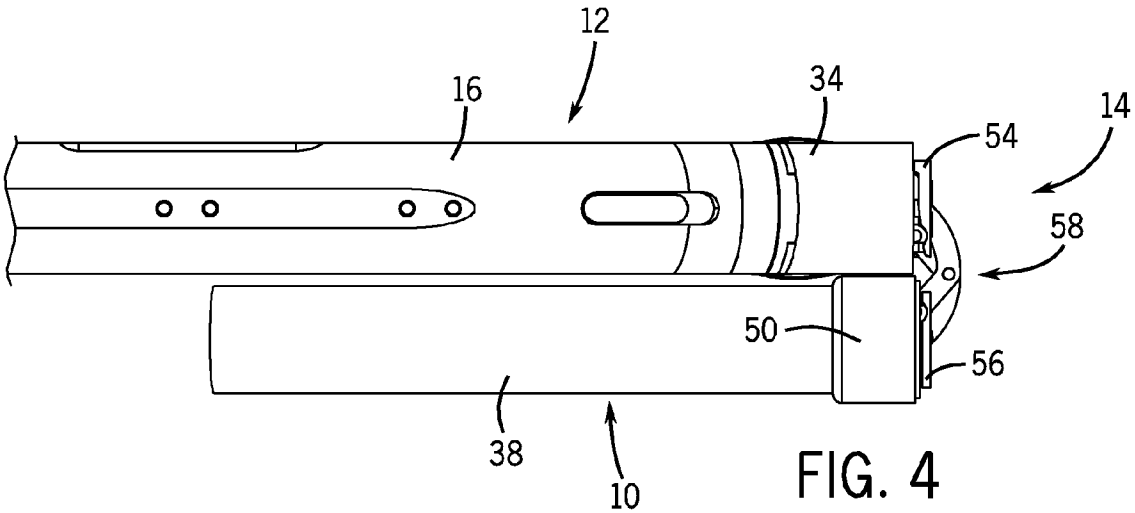
FIG. 4 is a top view of FIG. 3 showing the stock assembly in a folded position.

Once the hinge portions 54, 56 and translation linkage 58 have been respectively installed in the mounting device 34 and buffer tube 38 as described above, the folding stock assembly 10 is pivotable on the mounting device 34 of shotgun 12 between the unfolded position of FIG. 3 and the folded position of FIG. 4 alongside receiver 16. The stock assembly 10 is held in the unfolded position in locking alignment with the mounting device 34 and receiver 16 of shotgun 12 by means of the locking collar 50 which is slidably and rotatably mounted on the inner end 42 of buffer tube 38. To lock the stock assembly in the unfolded position, the collar 50 is slidably moved along the aligned hinge portions 54, 56 toward the mounting device 34 such that the opposed teeth 52 on collar 50 slide within the aligned slots 66, 88 of hinge portions 54, 56. When the outer end of locking collar 50 contacts the mounting device 34, the collar 50 is rotated so that the teeth 52 will ride along the ramp surfaces 80 and into locking notches 74 on hinge portion 54. The stock assembly 10 is now in positive locked alignment with the mounting device 34 of the shotgun 12 so that no folding can occur.

Figure 5:
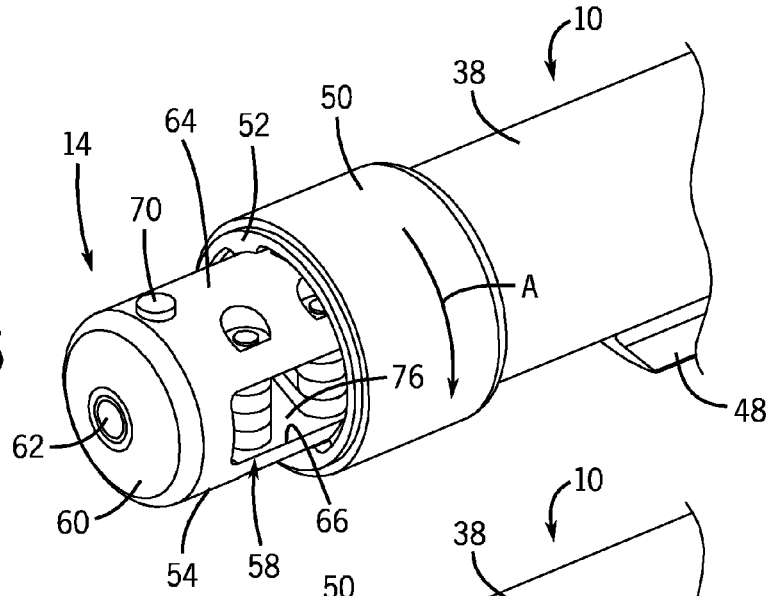
FIGS. 5-7 are fragmentary, perspective views of the stock assembly and hinge arrangement in various progressive stages enabling movement of the stock assembly from an unfolded position to a folded position.
Figure 6:
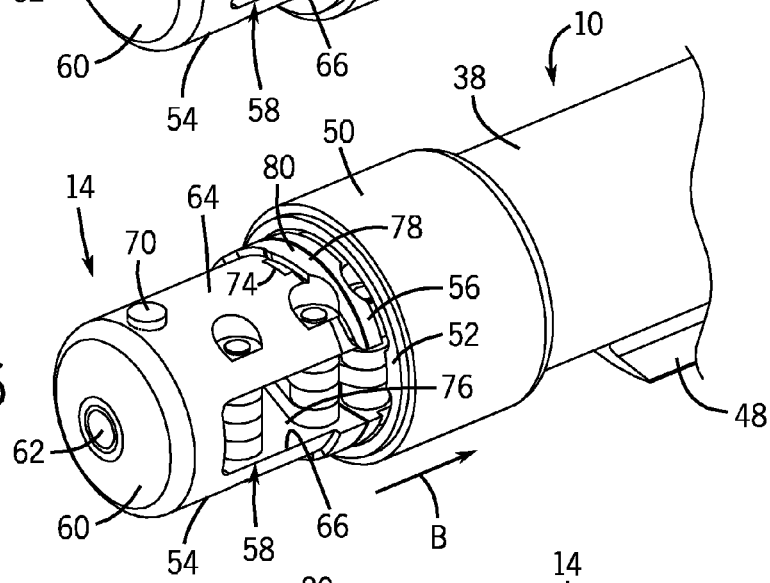
Figure 7:
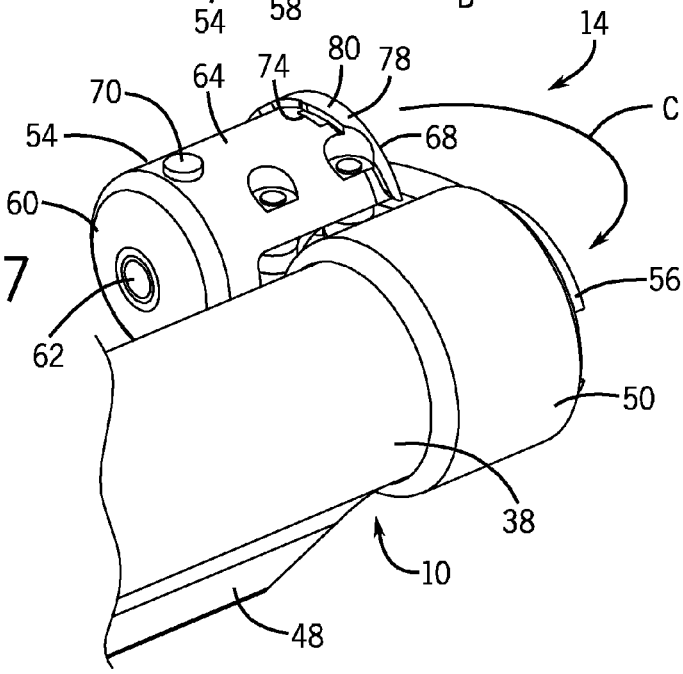

When it is desired to fold the stock assembly 10 alongside receiver 16 as shown in FIG. 4, it is necessary to disable the locking alignment and reverse the procedure described above. FIG. 5 shows the stock assembly 10 and the hinge arrangement 14 in aligned, locked and unfolded position with the shotgun 12 removed for clarity explanation. To unlock the stock assembly 10, the locking collar 50 is rotated in the direction of arrow A to disengage teeth 52 from the notches 74 and the ramp surfaces 80. The collar 50 is then slidably moved along buffer tube 38 in the direction of arrow B, shown in FIG. 6. During the sliding motion, the teeth 52 in collar 50 move within the slots 66, 88 to expose the gap or space 152 between the aligned hinge portions 54, 56. Now, the folding stock assembly 10 is pivoted or folded in the direction of arrow C via the translation linkage 58 inside the hinge portions 54, 56 to the folded position shown in FIG. 7. A magnetic and/or a mechanical fastener can be used to hold the stock assembly 10 in the folded position shown in FIG. 4. In the folded position of FIG. 4, the hinge arrangement 14 is only minimally exposed at the rear of the shotgun 12 which is believed to improve over known side folding stock assemblies.

It is a feature of the present disclosure that the hinge arrangement 14 lies completely concealed from view when the stock assembly 10 is moved to the unfolded locked position as seen in FIG. 1. This concealed design protects the hinge arrangement 14 from adverse environmental and operational conditions to enhance the reliability of the folding stock assembly 10. In addition, the concealed hinge arrangement 14 contributes to a clean streamlined appearance for the folding stock assembly 10 in its unfolded installed position.

Although the stock is shown in FIG. 4 as being folded along the left side of the firearm, the folding stock assembly 10 can be configured such that the stock can be folded along the right side of the firearm. This ability to modify the folding stock assembly enables the user to select the direction in which the stock folds.

Various alternatives are contemplated as being within the scope of the following claims particularly pointing out and distinctly claiming the subject matter regarded as the invention.

I claim:

1. A hinge arrangement for a firearm assembly comprising:

a first hinge portion adapted to be mounted in one of a firearm assembly and a stock assembly;

a second hinge portion adapted to be mounted in the other of the firearm assembly and the stock assembly; and a translation linkage position between the first and second hinge portions for permitting the first and second hinge portions to move into and out of spaced apart alignment with each other, the translation linkage being located substantially within the first and second hinge portions when the first and second hinge portions are moved toward each other, wherein one of the hinge portions is provided with a ramp surface structure and the other one of the hinge portions is provided with a locking notch structure to engage the ramp surface structure and lock the hinge arrangements to each other.

2. The hinge arrangement of claim 1, wherein each of the hinge portions is provided with external mounting structure adapted to be received and retained in the firearm assembly and the stock assembly.

3. The hinge arrangement of claim 1, wherein each of the hinge portions has a sidewall formed with slot structure.

4. The hinge arrangement of claim 1, wherein each of the hinge portions includes an interior mounting space for mounting the translation linkage.

5. The hinge arrangement of claim 1, wherein the hinge portions have internal mounting bases which are coplanar with each other when the hinge portions are moved into spaced apart alignment with one another.

6. The hinge arrangement of claim 1, wherein the translation linkage includes a set of swing arms swingably mounted on hinge pins, and configured in a stacked overlapping relationship.

7. The hinge arrangement of claim 6, wherein the hinge pins include a first set of hinge pins fixed relative to the hinge portions, and a second set of hinge pins movable relative to the hinge portions.

8. A folding firearm stock assembly comprising:

a shoulder stock assembly having a hinge arrangement including a first hinge portion adapted to be mounted to a rear portion of a firearm assembly, and a second hinge portion mounted to the shoulder stock assembly; and a translation linkage located between the first and second hinge portions for permitting the first and second hinge portions to move into and out of spaced apart alignment with one another, the translation linkage being located substantially within the first and second hinge portions when the first and second hinge portions are moved toward each other, wherein one of the hinge portions is provided with a ramp surface structure and the other one of the hinge portions is provided with a locking notch structure to engage the ramp surface structure and lock the hinge arrangements to each other.

9. The firearm stock assembly of claim 8, wherein the second hinge portion is mounted substantially entirely within the shoulder stock assembly.

10. The firearm stock assembly of claim 8, wherein the shoulder stock assembly includes a buffer tube for receiving and retaining the second hinge portion therein.

11. The firearm stock assembly of claim 10, wherein the buffer tube includes a locking collar which is engageable and disengagable with locking structure on the first hinge portion.

12. The firearm stock assembly of claim 11, wherein the locking collar is mounted for sliding and rotatable movement on the buffer tube.

13. The firearm stock assembly of claim 11, wherein the locking collar includes a tooth structure which is engageable and disengagable with a ramp surface structure on the first hinge portion.

14. The firearm stock assembly of claim 8, wherein the translation linkage includes a set of swing arms swingably mounted in a stacked overlapping relationship on a set of hinge pins fixedly and movably mounted in the hinge portions.

15. A firearm assembly comprising:

a shoulder stock assembly having a hinge arrangement including a first hinge portion mounted within a rear portion of a firearm assembly, and a second hinge portion mounted within the shoulder stock assembly, the shoulder stock assembly and the rear of the firearm assembly being movable into and out of locking alignment with one another; and a translation linkage located between the first and second hinge portions for permitting the first and second hinge portions to move into and out of spaced apart alignment with one another, the hinge portions and the translation linkage being substantially concealed from view when the shoulder stock assembly and the rear portion of the firearm assembly are moved into locking alignment with one another, wherein one of the hinge portions is provided with a ramp surface structure and the other one of the hinge portions is provided with a locking notch structure to engage the ramp surface structure and lock the hinge arrangements to each other.

16. The firearm assembly of claim 15, wherein the hinge portions are mounted so as to prevent any axial and rotational movement within the rear portion of the firearm assembly and the shoulder stock assembly.

17. The firearm assembly of claim 15, wherein the shoulder stock assembly includes a locking collar rotatably and slidably mounted thereon, the locking collar being engageable and disengagable with locking structure on the first hinge portion.

18. The firearm assembly of claim 15, wherein the translation linkage is located substantially entirely within the hinge portions when the hinge portions are moved into spaced apart alignment with one another.

* * * * *